US012150543B2

(12) United States Patent
Schroeder et al.

(10) Patent No.: US 12,150,543 B2
(45) Date of Patent: Nov. 26, 2024

(54) BRUSH COMPRISING A CARRIER MADE OF BAMBOO MATERIAL AND WIRE FOR FORMING STAPLES FOR A BRUSH OF THIS TYPE

(71) Applicant: BERKENHOFF GMBH, Heuchelheim (DE)

(72) Inventors: Waldemar Schroeder, Giessen (DE); Tobias Noethe, Herborn (DE)

(73) Assignee: BERKENHOFF GMBH, Heuchelheim (DE)

( * ) Notice: Subject to any disclaimer, the term of this patent is extended or adjusted under 35 U.S.C. 154(b) by 311 days.

(21) Appl. No.: 17/770,388

(22) PCT Filed: Oct. 23, 2020

(86) PCT No.: PCT/EP2020/079903
§ 371 (c)(1),
(2) Date: Apr. 20, 2022

(87) PCT Pub. No.: WO2021/078948
PCT Pub. Date: Apr. 29, 2021

(65) Prior Publication Data

US 2022/0386767 A1 Dec. 8, 2022

(30) Foreign Application Priority Data

Oct. 24, 2019 (DE) ..... 10 2019 128 786.3

(51) Int. Cl.
*A46B 3/16* (2006.01)

(52) U.S. Cl.
CPC ..... *A46B 3/16* (2013.01); *A46B 2200/1066* (2013.01)

(58) Field of Classification Search
CPC ..... A46B 3/16; A46D 3/042
See application file for complete search history.

(56) References Cited

U.S. PATENT DOCUMENTS 196,802 A * 11/1877 Hill ..... A46B 3/16 15/205
2,130,244 A * 9/1938 Nishio ..... A46B 3/16 15/190
5,724,697 A 3/1998 Klee et al.

FOREIGN PATENT DOCUMENTS

JP 6609 Y 1/1925
JP 3211072 U 6/2017
(Continued)

OTHER PUBLICATIONS

Japan Patent Office, Notice of Reasons for Rejection, Application No. 2022-524148, Mar. 5, 2024, 11 pages.
(Continued)

*Primary Examiner* — Shay Karls
(74) *Attorney, Agent, or Firm* — Quarles & Brady LLP

(57) ABSTRACT

A brush including a support made of bamboo material having a plurality of cluster holes each accommodating one bristle cluster fixed in a cluster hole by a clip having a length l greater than the diameter D of the cluster hole to form clip projections on both longitudinal ends. The clips have at least two wedges on at least one side disposed one above the other in the direction of the vertical axis and widening upward, the upper ends of the wedges forming catch shoulders extending in the longitudinal direction of the clip, wherein a press-in end of the clip having a reduced width is formed at a lower end of the lower wedge.

27 Claims, 4 Drawing Sheets

(56) References Cited

FOREIGN PATENT DOCUMENTS

| | | | |
|---|---|---|---|
| WO | 9805238 | A1 | 2/1998 |
| WO | 2006115963 | A2 | 11/2006 |

OTHER PUBLICATIONS

PCT International Search Report and Written Opinion, PCT/EP2020/079903, Mar. 3, 2021, 25 pages.

* cited by examiner

BRUSH COMPRISING A CARRIER MADE OF BAMBOO MATERIAL AND WIRE FOR FORMING STAPLES FOR A BRUSH OF THIS TYPE

This application represents the national stage entry of PCT International Patent Application No. PCT/EP2020/079903 filed on Oct. 23, 2020 and claims priority to German Patent Application No. 10 2019 128 786.3 filed Oct. 24, 2019. The contents of each of these applications are hereby incorporated by reference as if set forth in their entirety herein.

The present disclosure relates to a brush comprising a support made of bamboo material for disposing bristle clusters thereon, the support having a plurality of cluster holes each serving to accommodate one bristle cluster, the bristle clusters each being fixed in a cluster hole by means of a clip, the clips having a length 1 greater than the diameter D of the cluster hole for forming clip projections formed on both longitudinal ends, and the clips having at least two wedges on at least one of two opposite longitudinal sides at least in the area of the clip projections, the wedges being disposed one above the other in the direction of the vertical axis and widening upward, wherein a press-in end of the clip is formed at a lower end of the lower wedge, the width of the press-in end being reduced compared to the width of the clip. Moreover, the disclosure relates to a wire for forming clips for such a brush.

A brush comprising a support which is made of plastic material and which has bristle clusters fixed in cluster holes by means of wire clips is known from WO 98/05238. The wire clips used for this purpose have a double wedge profile which is symmetrical to a vertical clip axis and in which two wedges disposed one above the other in the direction of the vertical clip axis and widening upward are disposed on opposite longitudinal sides. A press-in end whose width corresponds to the width of the clip is formed at the lower end of the lower wedge, the press-in end being rounded across its entire width with a view to a tight contact with the bristle clusters which does not damage the bristle clusters, if possible, with the result that the bristle cluster is accommodated between the wire clip and the surrounding plastic material of the support in a U-shape. Contrary to the press-in end which is rounded across its entire width, the wedge-shaped design of the longitudinal sides of the clip is supposed to form sharp-edged grooves at the edges, the grooves forming a saw tooth-like cross section in order to enable a corresponding anchoring in the plastic material of the support.

In tests carried out by the applicant, it has been found that wire clips of this design are not well suited for anchoring bristle clusters in cluster holes of a support made of bamboo material, the reason for this obviously lying in the poor creeping behavior of the bamboo material compared to a plastic material. In WO 98/05238, the anchoring effect achieved with the known wire clip in the plastic material is ascribed to the fact that the creeping behavior of the plastic material causes it to fill the sharp-edged grooves formed by the double wedge profile when it is plastically deformed.

In using the wire clips known from WO 98/05238 for anchoring bristle clusters in a support made of bamboo material, it has been found that the pulling forces required for reliably fixing the bristle clusters in the support are not achieved—obviously owing to the insufficient plastic deformation.

Hence, the object of the disclosure is to propose a brush which allows sufficient pulling forces to be achieved in connection with a support made of bamboo material for disposing bristle clusters thereon, i.e., which also allows the desired reliable fixing of bristle clusters in the support of a brush comprising a support made of bamboo material.

In the case of the brush according to the disclosure, which comprises a support made of bamboo material for disposing bristle clusters thereon, the support having a plurality of cluster holes each serving to accommodate one bristle cluster, the bristle clusters each being fixed in a cluster hole by means of a clip, the clips having a length 1 greater than the diameter D of the cluster hole for forming clip projections at both longitudinal ends, and the clips having at least two wedges on at least one of two opposite longitudinal sides at least in the area of the clip projections, the wedges being disposed one above the other in the direction of the vertical axis and widening upward, the upper ends of the wedges forming catch shoulders extending in the longitudinal direction of the clip, a press-in end of the clip is formed at a lower end of the lower wedge, the width of the press-in end being reduced compared to the width of the clip.

When fixing the bristle cluster, the clip is pressed into the cluster hole together with the bristle cluster, which is in contact with the press-in end, with the result that the clip projections formed at the longitudinal ends of the clip relative to the diameter of the cluster holes penetrate the bamboo material. The press-in end of the clip, whose width is reduced compared to the width of the clip at the lower end of the lower wedge according to the disclosure, has a narrow front compared to the clip width, which allows the unidirectionally disposed fiber bundles of the bamboo material to be spread apart without the bamboo fibers being destroyed during the pressing-in process. Instead, the fiber bundles slide along the wedge surfaces during the pressing-in process to spring back into catch grooves, which are formed since the wedges are disposed one above the other, owing to elastic restoring forces.

If the press-in end is formed by the lower end of the lower wedge, the press-in end can have a press-in flank whose inclination corresponds to the wedge angle.

In a particularly preferred embodiment, the press-in end is formed as an extension formed at the lower end of the lower wedge with the result that the press-in flanks can have a flank angle which is different from the angle of the wedge surface. The press-in flanks are preferably parallel to the vertical axis of the clip.

It has proven particularly advantageous for the width of the press-in end to be 0.5 times to 1.5 times the width of a catch shoulder with the result that the elastic restoring forces allow the bamboo fibers to mold themselves to the clip after they have been previously spread apart by the press-in end.

It also has an advantageous effect with a view to the molding of the bamboo fibers to the clip after having been spread apart if the height of the wedges is 4 to 8 times the width of the press-in end.

It has proven particularly advantageous for adjacent wedges to be spaced apart from each other by spacers for forming catch grooves, the spacers forming a groove bottom in such a manner that a wedge surface of the upper wedge rising from the groove bottom forms a groove flank and the catch shoulder of the lower wedge forms an opposite groove flank. This means that a space is formed between the wedges, which is available for being filled by the bamboo material and forms as large a contact surface as possible for a form fit between the bamboo material and the clip. At the same time, the enlarged contact surface formed by the catch groove allows a correspondingly increased friction lock between the bamboo material and the clip, both effects contributing to an increase in the pulling force.

Advantageously, the groove bottom has a width between 0.05 and 0.6 mm, particularly preferably a width between 0.2 and 0.4 mm.

Furthermore, it has proven advantageous for the catch grooves to have a groove bottom which is parallel to the vertical clip axis.

An elastic restoration of the fibers into the catch grooves which is as gentle on the fiber structure of the bamboo fibers as possible becomes possible if a transition formed between a wedge and the catch shoulder is formed as a convex transition edge. This avoids the formation of sharp-edged grooves as occurring in the state of the art.

Another embodiment which is advantageous with a view to reduced pressing-in forces and which supports the bamboo fibers in molding themselves to the clip as constantly as possible across the entire height of the clip is made possible if the upper one of each two wedges disposed one above the other has a catch shoulder having a greater width than the catch shoulder formed by the lower wedge.

The catch shoulder of the respective upper wedge preferably has a width which is greater than the catch shoulder of the respective lower wedge by between 5% and 15%.

An embodiment of the brush in which the clip is symmetrical to the vertical axis in such a manner that the wedges formed on opposite longitudinal sides form a symmetrical double wedge profile with the result that forces perpendicular to the vertical axis can be avoided during the pressing-in process and a defined alignment of the clip in the support is facilitated is particularly preferred.

The brush configured according to the disclosure enables the provision of a brush in which sufficient pulling forces can be achieved with relatively smaller clip projections with the result that a very high bristle cluster density can be achieved with a plurality of cluster holes disposed at a relatively small distance from each other with the result that the brush according to the disclosure is particularly suitable for being turned into a toothbrush.

In the case of the wire according to the disclosure, which is suitable for forming clips for a brush according to the disclosure, the wire has wedges on at least one of two opposite longitudinal sides, the wedges being disposed one above the other in the direction of the vertical axis and widening upward, the upper ends of the wedges forming catch shoulders extending in the longitudinal direction of the wire, and a lower wire edge which has a width which is reduced compared to the wire width being formed at a lower end of the lower wedge.

The wire edge is preferably formed by the lower end of the lower wedge.

The wire edge is preferably formed as an extension formed at the lower end of the lower wedge.

The width of the wire edge is preferably 0.5 times to 1.5 times the width of a catch shoulder.

The height of the wedges is preferably 4 to 8 times the width of the wire edge.

It is particularly preferred for adjacent wedges to be spaced apart from each other by means of spacers for forming catch grooves, the spacers forming a groove bottom in such a manner that a wedge surface of the upper wedge rising from the groove bottom forms a groove flank and the catch shoulder of the lower wedge forms an opposite groove flank.

The groove bottom preferably has a width between 0.05 and 0.6 mm, particularly preferably a width between 0.2 and 0.4 mm.

The catch grooves preferably have a grove bottom which is parallel to the vertical axis of the wire.

A transition formed between a wedge surface and a catch shoulder is preferably formed as a convex transition edge.

The upper one of each two wedges disposed one above the other preferably has a catch shoulder having a greater width than the catch shoulder formed by the lower wedge.

The wire is preferably symmetrical to a vertical axis in such a manner that the wedges formed on the opposite longitudinal sides form a symmetrical double wedge profile.

It has proven particularly advantageous with a view to achieving pulling forces as high as possible if the wire has a brass, nickel silver or aluminum alloy.

Hereinafter, a preferred embodiment of the brush using a preferred embodiment of the wire will be explained in more detail with reference to the drawing.

Figure 1:
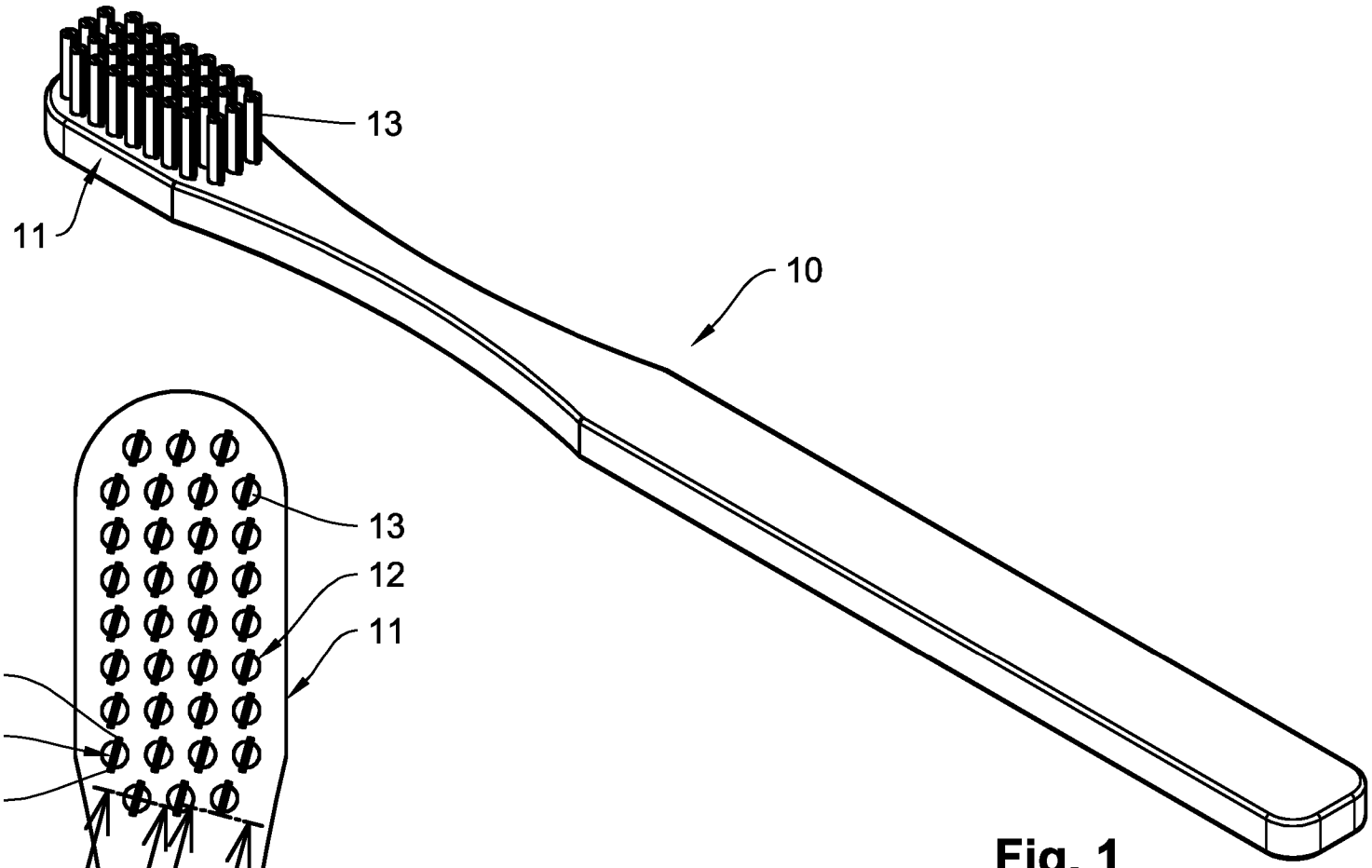
FIG. 1 is an isometric illustration of an embodiment in which the brush is a tooth brush.
Figure 2:
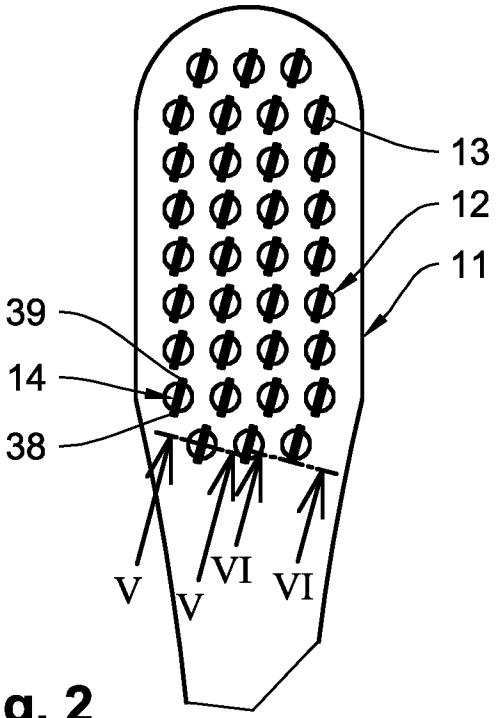
FIG. 2 shows a brush head of the brush illustrated in FIG. 1 with clips pressed into cluster holes of a brush head.

FIG. 1 shows a brush 10, which is a toothbrush in the embodiment example illustrated and which has a support 11, which is a brush head in this case and is illustrated in plan view in FIG. 2 and comprises a plurality of cluster holes 12, which are disposed in the shape of a raster in this case and are each equipped with a bristle cluster 13, which is anchored in cluster hole 12 by means of a clip 14.

Figure 3:
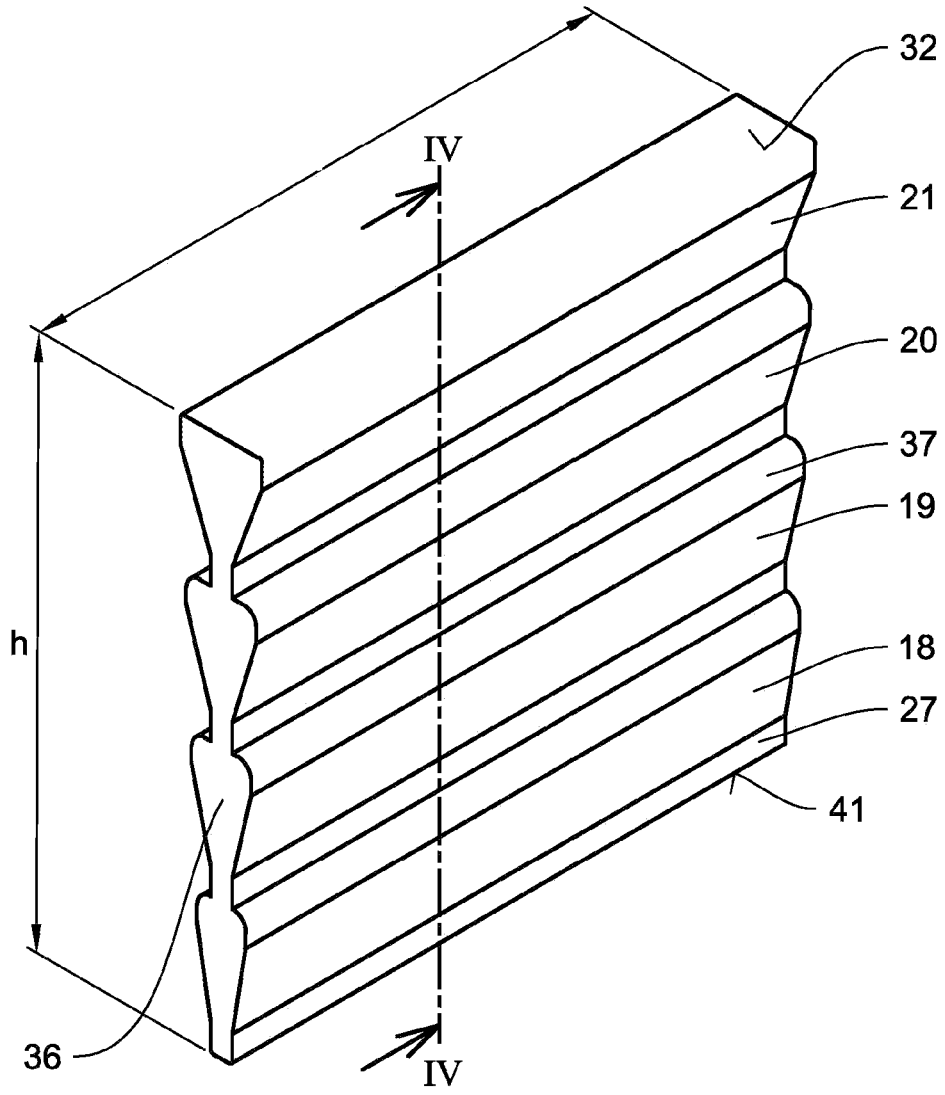
FIG. 3 is an isometric illustration of a clip.
Figure 4:
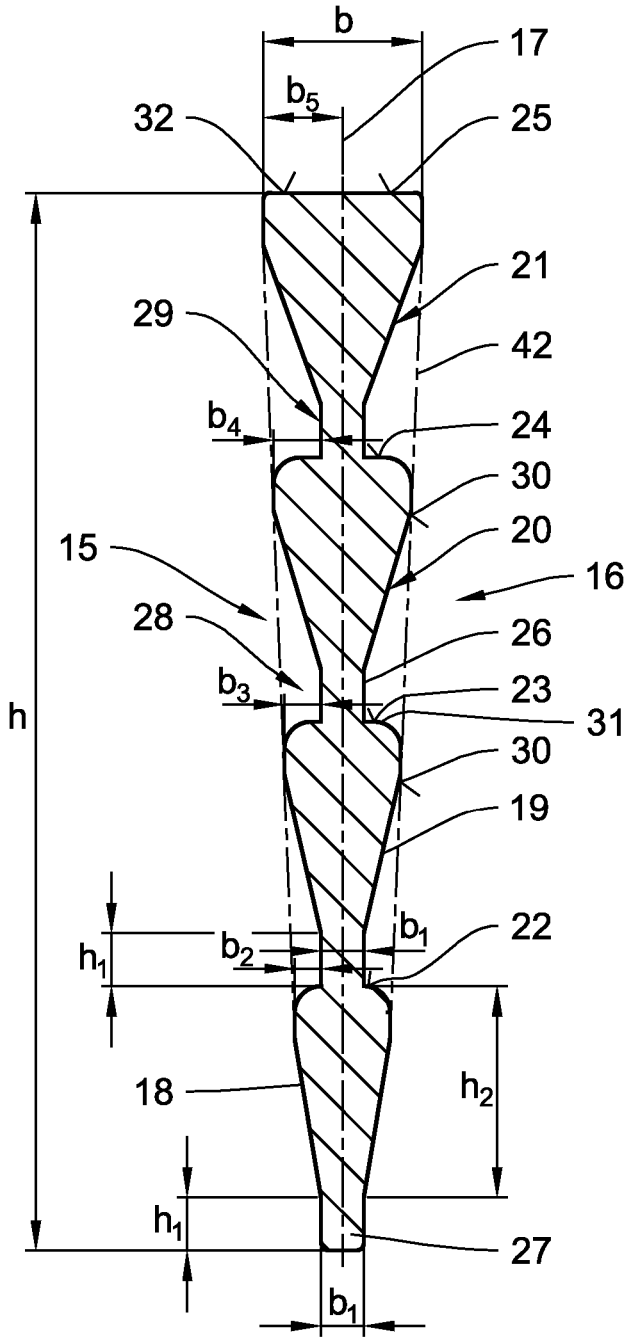
FIG. 4 is a sectional illustration of the clip illustrated in FIG. 3 according to line IV-IV in FIG. 3.

Clip 14 illustrated in FIGS. 3 and 4 is produced from a portion of a wire which, in the case of the embodiment example illustrated, has four wedges 18, 19, 20 and 21, which are disposed one above the other in the direction of a vertical axis 17, on both opposite longitudinal sides 15 and 16 symmetrically to vertical axis 17, wedges 18, 19, 20 and 21 having an identical height $h_2$ in the case of the embodiment example at hand and forming catch shoulders 22, 23, 24 and 25, which extend in the longitudinal direction of clip 14.

As shown in FIG. 4 in particular, wedges 18, 19, 20 and 21 widen toward upper ends, which form catch shoulders 22, 23, 24 and 25, respective spacers 26 being formed between wedges 18 and 19, wedges 19 and 20, and wedges 20 and 21, which are adjacent in the direction of vertical axis 17, each spacer 26 having a width $b_1$, which is defined by the lower tapered end of wedges 19, 20 and 21, and a height $h_1$. A press-in end 27 is formed at a lower end of lower wedge 18, press-in end 27 having both the same width $b_1$ and the same height $h_1$ as spacer 26 in the embodiment example at hand.

Respective catch grooves 28 are formed between wedges 18 and 19, wedges 19 and 20 and wedges 20 and 21, which are adjacent in the direction of vertical axis 17, each spacer 26 forming a groove bottom 29, a groove flank 30, which rises from groove bottom 29, being formed by a wedge surface 30 of upper wedges 19, 20 and 21, respectively, and an opposite groove flank 31 being formed by catch shoulders 22, 23 and 24, respectively.

As further shown in FIG. 4 in particular, catch shoulders 22, 23, 24 and 25 of wedges 18, 19, 20 and 21, which are disposed one above the other in the direction of vertical axis 17, have increasing widths $b_2$, $b_3$, $b_4$ and $b_5$, the fact that wedges 18, 19, 20 and 21 are disposed symmetrically to vertical axis 17 having the effect that an upper wire edge 32, which is formed by the catch shoulders of uppermost wedge 21, has double width $b_5$. Contrary to upper wire edge 32, which is formed by catch shoulders 25 and which simultaneously determines thickness b of the clip, press-in end 27, which is formed by a lower wire edge 41, has reduced thickness $b_1$.

Figure 6:
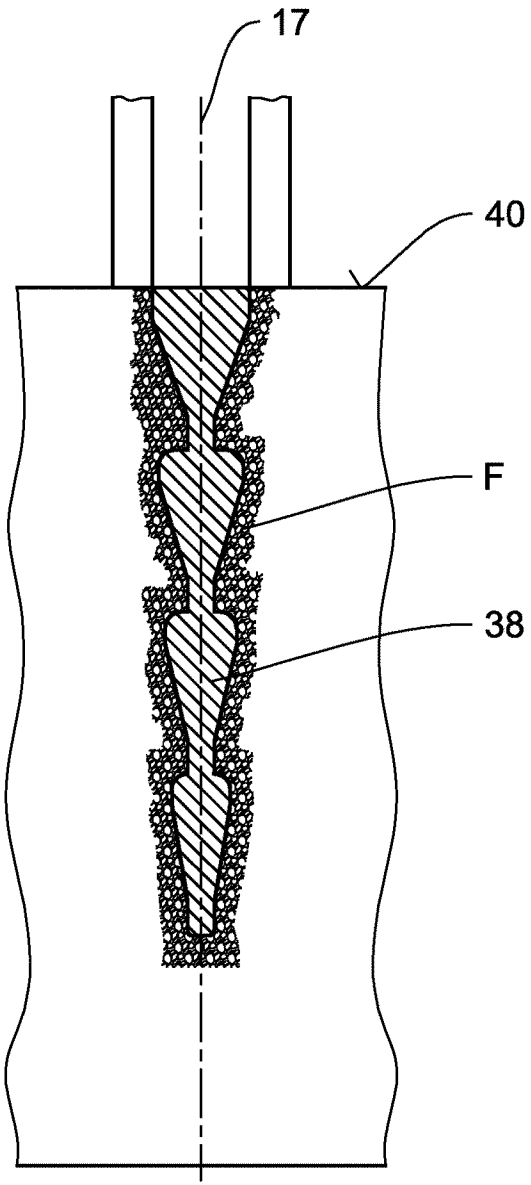
FIG. 6 is a partial sectional illustration of the brush head illustrated in FIG. 2 according to line VI-VI in FIG. 2.
Figure 5:
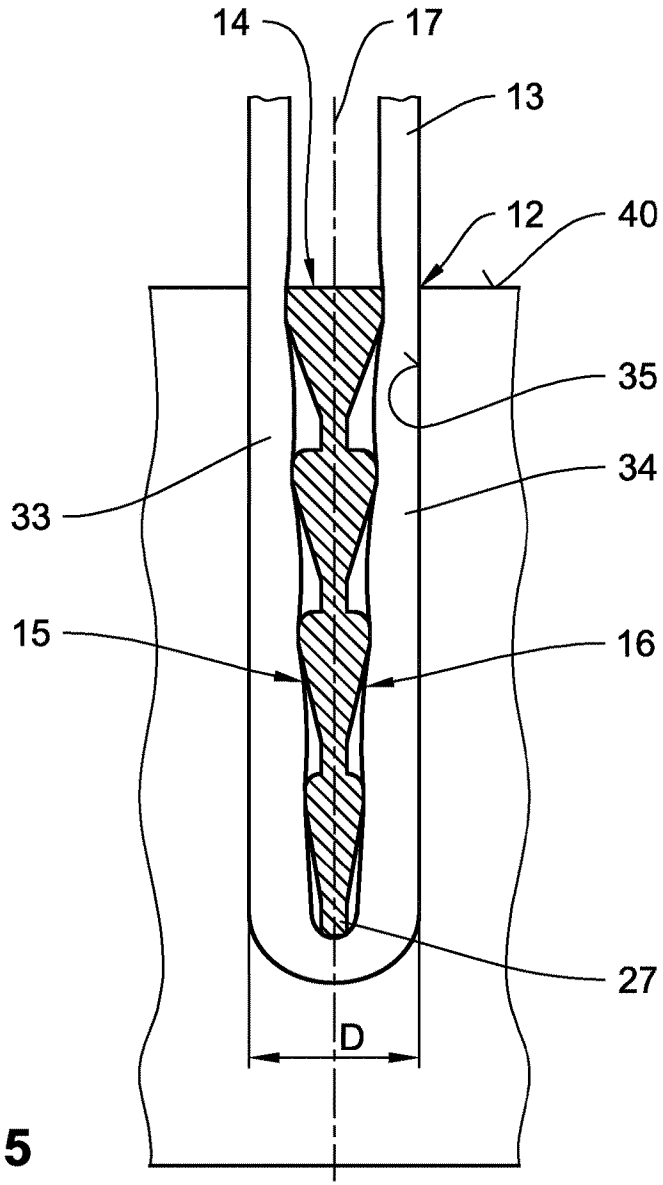
FIG. 5 is a partial sectional illustration of the brush head illustrated in FIG. 2 according to line V-V in FIG. 2.

As illustrated in FIGS. 5 and 6, bristle clusters 13 are held in cluster holes 12 as bristle clusters 13 are molded to longitudinal sides 15 and 16 and press-in end 27 in a U-shape and are accommodated in cluster hole 12 together with clip 14 in such a manner that cluster strands 33 and 34, which extend parallel to each other, are each accommodated between a longitudinal side 15, 16 of clip 14 and a hole wall 35. In a pressing-in process, which is necessary for achieving this arrangement, bristle cluster 13, which is wrapped around press-in end 27, is inserted into cluster hole 12 in the direction of vertical axis 27, clip projections 38 and 39 (FIG. 2), which are formed by longitudinal ends 36 and 37 of clip 14 and protruding beyond diameter D of cluster hole 12, being simultaneously pressed into the bamboo material of support 11 limiting cluster hole 12 in the direction of vertical axis 17 in such a manner that an essentially flush arrangement of upper wire edge 32 in a support surface 40 is achieved, as illustrated in FIG. 6.

As is apparent from FIG. 6, catch grooves 28, which are formed between wedges 18 and 19, wedges 19 and 20 and wedges 20 and 21, which are adjacent in the direction of vertical axis 17, enable the formation of free spaces between catch shoulders 22, 23 and 24 of the respective lower wedges and the lower ends of the respective upper wedges, fiber strands F of the bamboo material, which are formed unidirectionally in the bamboo material and are essentially parallel to longitudinal sides 15 and 16 and are oriented in the direction of the longitudinal axis of clip 14, being able to fill a large portion of said free spaces owing to elastic restoring forces after a preceding spreading of fiber strands F in the course of the pressing-in process with the result that a form fit is established between clip 14 and the bamboo material.

As is also clearly visible in FIG. 6, the fact that wedges 18, 19, 20 and 21 are disposed one above the other in the direction of vertical axis 17 in combination with a width of catch shoulders 22, 23, 24 and 25 which increases from press-in end 27 toward upper wire edge 32 in the direction of vertical axis 17 enables the formation of an overall wedge-shaped clip cross section 42, which is indicated by the dashed line in FIG. 4. Clip 14 thus has a wedge-shaped total cross section which is composed of wedge-shaped portions.

As has been found in tests for measuring the pulling forces required for removing bristle clusters 13 which are fixed in cluster holes 12 by means of clip 14 according to the illustrations in FIGS. 5 and 6 from support 10, the formation of clip 14 with a wedge-shaped total cross section composed of wedge-shaped portions disposed one above the other in the direction of vertical axis 17 as illustrated in FIG. 4 enables a substantial increase in the pulling forces compared to a clip configured according to WO 98/05238.

With an identical wire alloy of CuZn37 used for clip production, identical dimensions of the clips with a height h=2 mm and a width b=0.3 mm, an increase in the pulling forces of more than 30% could be achieved. In addition to this increase in the pulling forces, the clip weight could be reduced by more than 7% owing to the wedge-shaped total cross section illustrated in FIGS. 5 and 6.

The invention claimed is:

1. A brush comprising a support made of bamboo material for disposing bristle clusters thereon, the support having a plurality of cluster holes each serving to accommodate one bristle cluster, the bristle clusters each being fixed in a cluster hole by means of a clip, the clips having a length l greater than the diameter D of the cluster hole so as to form clip projections formed on both longitudinal ends, and the clips having at least two wedges on at least one of two opposite longitudinal sides at least in the area of the clip projections, the wedges being disposed one above the other in the direction of the vertical axis and widening upward, the upper ends of the wedges forming catch shoulders extending in the longitudinal direction of the clip, wherein a press-in end of the clip is formed at a lower end of the lower wedge, a width $b_1$ of the press-in end being reduced compared to a width b of the clip.

2. The brush according to claim 1, wherein the press-in end is formed by the lower end of the lower wedge.

3. The brush according to claim 1, wherein the press-in end is formed as an extension formed at the lower end of the lower wedge.

4. The brush according to claim 3, wherein the width of the press-in end is 0.5 times to 1.5 times the width of a catch shoulder.

5. The brush according to claim 1, wherein the height $h_2$ of the wedges is 4 to 8 times the width $b_1$ of the press-in end.

6. The brush according to claim 1, wherein for forming catch grooves, adjacent wedges are spaced apart from each other by spacers which form a groove bottom in such a manner that a wedge surface of the upper wedge rising from the groove bottom forms a groove flank and the catch shoulder of the lower wedge forms an opposite groove flank.

7. The brush according to claim 6, wherein the groove bottom has a width between 0.05 and 0.6 mm.

8. The brush according to claim 6, wherein the groove bottom has a width between 0.2 and 0.4 mm.

9. The brush according to claim 6, wherein the catch grooves have a groove bottom which is parallel to the vertical axis.

10. The brush according to claim 6, wherein a transition formed between the wedge surface and the catch shoulder is formed as a convex transition edge.

11. The brush according to claim 1, wherein the upper one of two wedges disposed one above the other has a catch shoulder having a greater width than the catch shoulder formed by the lower wedge.

12. The brush according to claim 11, wherein the catch shoulder of the respective upper wedge has a width which is greater than the catch shoulder of the respective lower wedge by between 5 and 15%.

13. The brush according to claim 1, wherein the clip is symmetrical to the vertical axis, which means that the wedges formed on opposite longitudinal sides form a symmetrical double wedge profile.

14. The brush according to claim 1, wherein the brush is a toothbrush.

15. A wire for forming clips for a brush according to claim 1, wherein the wire has wedges on at least one of two opposite longitudinal sides, the wedges being disposed one above the other in the direction of the vertical axis and widening upward, the upper ends of the wedges forming catch shoulders extending in the longitudinal direction of the wire, and a lower wire edge being formed at a lower end of the lower wedge, the lower wire edge having a reduced width $b_1$ compared to wire width b.

16. The wire according to claim 15, wherein the lower wire edge is formed by the lower end of the lower wedge.

17. The wire according to claim 15, wherein the lower wire edge is formed as an extension formed at the lower end of the lower wedge.

18. The wire according to claim 15, wherein the width $b_1$ of the wire edge is 0.5 times to 1.5 times the width of a catch shoulder.

19. The wire according to claim 15, wherein the height $h_1$ of the wedges is 4 to 8 times the width $b_1$ of the lower wire edge.

20. The wire according to claim 15, wherein for forming catch grooves, the adjacent wedges are spaced apart from each other by spacers which form a groove bottom in such a manner that a wedge surface of the upper wedge rising from the groove bottom forms a groove flank and the catch shoulder of the lower wedge forms an opposite groove flank.

21. The wire according to claim 20, wherein the groove bottom has a width between 0.05 and 0.6 mm.

22. The wire according to claim 20, wherein the groove bottom has a width between 0.2 and 0.4 mm.

23. The wire according to claim 20, wherein the catch grooves have a groove bottom which is parallel to the vertical axis of the wire.

24. The wire according to claim 15, wherein a transition formed between a wedge surface and a catch shoulder is formed as a convex transition edge.

25. The wire according to claim 15, wherein the upper one of two wedges disposed one above the other has a catch shoulder having a greater width than the catch shoulder formed by the lower wedge.

26. The wire according to claim 15, wherein the wire is symmetrical to a vertical axis, which means that the wedges formed on the opposite longitudinal sides form a symmetrical double wedge profile.

27. The wire according to claim 15, wherein the wire has a brass, nickel silver or aluminum alloy.

* * * * *